United States Patent [19]

Brooks

[11] 4,131,122

[45] Dec. 26, 1978

[54] UMBRELLA STRUCTURE

[75] Inventor: C. Robert Brooks, Great Neck, N.Y.

[73] Assignee: 'Totes', Incorporated, Cincinnati, Ohio

[21] Appl. No.: 847,844

[22] Filed: Nov. 2, 1977

[51] Int. Cl.[2] ..... A45B 9/04

[52] U.S. Cl. ..... 135/76; 135/79; 248/532

[58] Field of Search ..... 135/65, 76, 78, 79, 135/20 R; 248/532

[56] References Cited

U.S. PATENT DOCUMENTS

| | | | |
|---|---|---|---|
| 281,245 | 7/1883 | Degenhart | 135/78 X |
| 435,446 | 9/1890 | Pattee | 248/532 |
| 444,189 | 1/1891 | Wildhack | 135/79 |
| 473,016 | 4/1892 | Pattee | 248/532 |
| 730,466 | 6/1903 | Maass | 135/79 |
| 2,612,335 | 9/1952 | Saltzman | 135/79 X |

FOREIGN PATENT DOCUMENTS

| | | | |
|---|---|---|---|
| 477182 | 9/1951 | Canada | 135/79 |
| 452583 | 10/1927 | Fed. Rep. of Germany | 135/78 |
| 75112 | 6/1917 | Switzerland | 135/78 |
| 15521 | 3/1909 | United Kingdom | 248/532 |

*Primary Examiner*—Ernest R. Purser
*Assistant Examiner*—Conrad L. Berman
*Attorney, Agent, or Firm*—Wood, Herron & Evans

[57] ABSTRACT

An improved umbrella structure having a unique handle that permits the umbrella to be staked into the ground, right side up, when desired by the user. The handle, in preferred form, includes a pin having a stake-like point at one end and a threaded shank at the other end, and a cap that can be threadedly connected with the shank. In the stake position, the pin is threaded into the umbrella's handle so that the stake-like point is exposed, and the cap is inserted in the user's pocket. In the storage position, the pin is threaded into the umbrella's handle so that the stake-like point is received in a storage cavity defined in that handle, and the cap is threaded onto the pin so as to protect the threaded shank and establish an aesthetically pleasing contour to the handle.

3 Claims, 3 Drawing Figures

UMBRELLA STRUCTURE

This invention relates to umbrellas. More particularly, this invention is directed to an improved umbrella structure.

Umbrellas are often carried by sportsmen, e.g. golfers, for protection in the event of rain. In the case of a golfer, the umbrella can be easily carried in or connected to the golfer's bag, thereby making it readily available at all times during the course of play. In the event of rain, however, the umbrella is normally used by the golfer only as he walks from one shot to the next. When the golfer desires to hit the ball with a club, he must set the umbrella down on the ground because, of course, both hands are required to swing the golf club. And the umbrella is normally set on the ground in the erect or open attitude, i.e., the golfer does not take the time to fold the umbrella up into its storage attitude. When set on the ground, during rain showers, it is not unusual on a golf course to find an open umbrella being blown across the fairway or green.

The problem that this invention solves, therefore, is one of providing an improved umbrella structure which can be readily and easily furnished with a stake-like point so it can be staked to the ground when it is being used on, e.g., a golf course, yet permits that stake-like point to be stored within the umbrella's handle during periods of normal use where staking to the ground is not desired, or during periods of non-use.

Umbrellas adapted to be staked into the ground are known to the prior art. For example, Pesatura Pat. No. 2,759,486 discloses a lawn-type umbrella having a stake end on its center shaft for holding the umbrella in a staked position in the ground. Further in this regard, Gravatt Pat. No. 3,662,771 discloses a special pointed attachment to be removably fixed onto an umbrella's tip for staking the umbrella to the ground; this structure is illustrated in a golfer's umbrella environment. The problem with the Pesatura umbrella is that the staked end is permanently attached, and would not provide a suitable handle adapted for manual use when the umbrella is being carried by a user under conditions where staking to the ground is not a desirable or necessary function. The problem with the Gravatt umbrella is that the umbrella must be staked to the ground with the cover inverted or upside down, thereby exposing it to the collection of rain. When the Gravatt umbrella is reinverted into the use position over the user's head, of course all the water collected would rain down on the user's head and shoulders.

Therefore, it has been a primary objective of this invention to provide an improved umbrella structure having a unique handle by which that handle structure can be arranged to present a stake end for holding the umbrella in a staked position in the ground, and by which that stake end can be stored within the handle in a manner that presents an aesthetically pleasing contour to the handle.

In accord with the objective of this invention, the improved umbrella structure includes a unique handle that permits the umbrella to be staked into the ground, right side up, when desired by the user. The handle, in preferred form, includes a pin having a stake-like point at one end and a threaded shank at the other end, and a cap that can be threadedly connected with the shank. In the stake position, the pin is threaded into the umbrella's handle so that the stake-like point is exposed, and the cap is inserted in the user's pocket. In the storage position, the pin is threaded into the umbrella's handle so that the stake-like point is received in a storage cavity defined in that handle, and the cap is threaded onto the pin so as to protect the threaded shank and establish an aesthetically pleasing contour to the handle.

Other objectives and advantages of this invention will be more apparent from the following detailed description, taken in conjunction with the drawings, in which.

Figure 1:
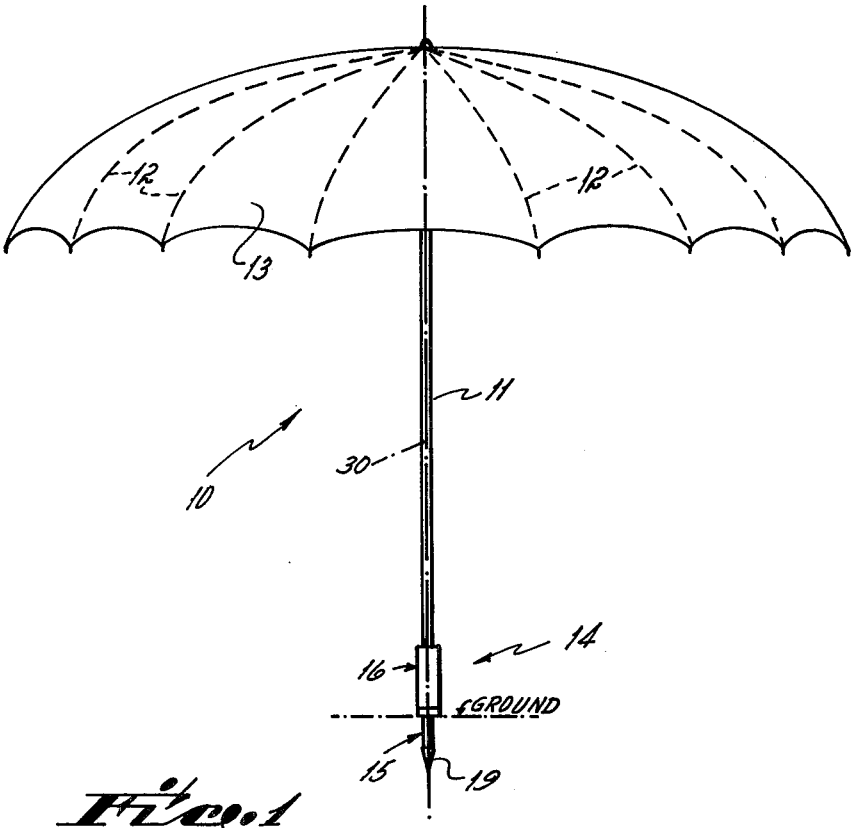
FIG. 1 is a perspective view illustrating an improved umbrella structure in accord with the principles of this invention, the umbrella being staked in the ground.

The improved umbrella structure 10, in accord with the principles of this invention, includes a center post 11, a rib structure 12, and a cloth cover 13 all in accord with umbrella principles known to the prior art, see FIG. 1. The improved umbrella structure also includes a novel handle 14.

Figure 2:
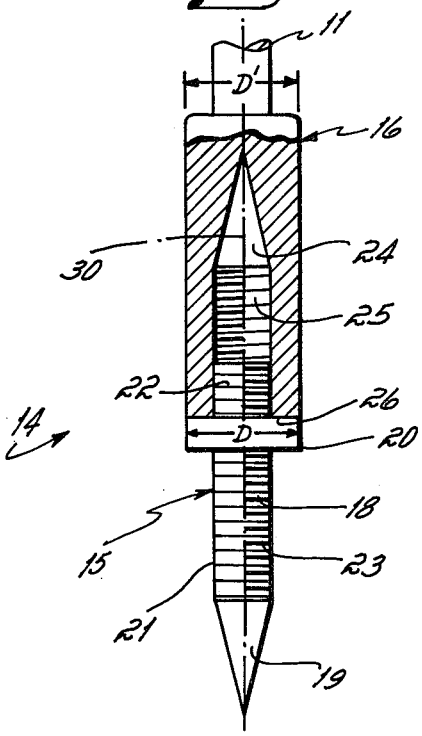
FIG. 2 is a longitudinal cross-section view of the umbrella's handle in the stake position shown in FIG. 1.
Figure 3:
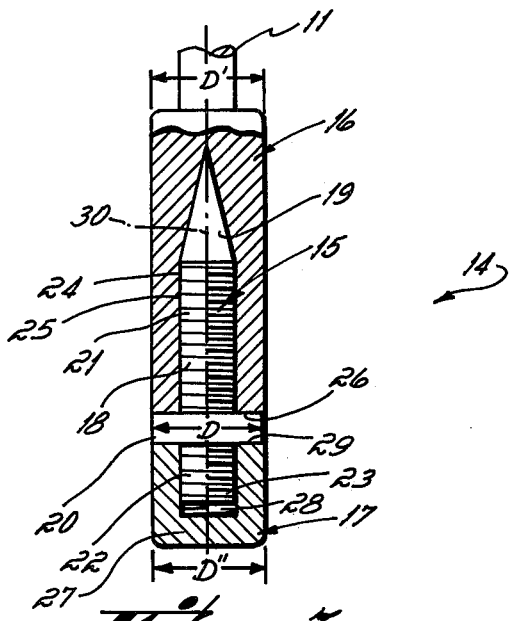
FIG. 3 is a longitudinal cross-section view of the umbrella's handle in the storage position.

The unique handle 14 is particularly illustrated in FIGS. 2 and 3, and includes pin 15 that is reversible between a storage position interiorly of handle section 16 (as shown in FIG. 2), and a stake position exteriorly of that handle section (as shown in FIG. 3). The handle section 16 is fixed immobily to the center post 11. The handle 14 also includes cap 17.

The pin 15 is comprised of a connector shank 18 at one end, and a stake-like point 19 at the other end. The connector shank 18 is divided by a collar 20 into a stake section 21 and a storage section 22, both sections being threaded with male threads 23 on the exterior surface thereof. Note collar 20 is of an outside diameter D equal to the outside diameter D′ of the handle section 16. Handle section 16 is generally hollow on the interior thereof without the pin 15 inserted in operative combination therewith, thereby defining storage chamber 24 for the pin's stake-like point 19. Note that the cross sectional size and geometry of the hollow chamber 24 defined in the handle section 16 is symetrical with that of the stake-like point 19 so that the pin's point 19 can be received in that chamber in seated, i.e., reinforced, relation therewith, as shown in FIG. 3. The hollow chamber 24 includes female threads 25 at open end 26 to cooperate with threads 22,23 on the pin 15. The handle's cap 17 is closed by headplate 27, and is of an outside diameter D″ equal to the outside diameters D and D′ of the pin's collar 20 and the handle section 16, respectively. The cap includes female threads 28 at open end 29 to cooperate with threads 23 on the storage section 21 of the pin's shank 22. Note, therefore, that the threads on both the stake 22 and storage 21 sections of the pin's shank 18 are of the same pitch diameter, which pitch diameter is sized to cooperate with the pitch diameter of handle section's threads 25 and of cap's threads 28. Note also that the handle 14 defines a linear axis 30, the reversible pin 15 and the cap 17 being positioned coaxially with that handle axis and, therefore, coaxially with the umbrella's centerpost 11 (since the handle 14 is coaxially aligned with the umbrella's centerpost) in both the stake position shown in FIGS. 1 and 2, and the storage position shown in FIG. 3.

In use, and in the storage position, the reversible pin 15 is inserted with the stake-like point 19 into the handle's 22 of the threaded shank 18 on being threaded into the handle section's threaded end 25 so as to retain the reversible pin in fixed relation within that chamber, see FIG. 3. The pin 15 is positively located and stopped in seated relation within chamber 24 when collar 20 on the shank 18, which collar is of the same general outside diameter as the handle section 16, abuts free end 26 of that handle section. Thereafter, and in the storage position for handle 14, the cap 17 is threaded onto the stake section 21 of the threaded shank 18 until the cap's free end 29 abuts the collar 20. In this storage attitude, the main handle section 16, collar 20 and cap 17 are all operatively connected together in a handle structure having a linear axis 30, and presenting a generally smooth exterior surface which is, of course, aesthetically desirable for the user of the umbrella.

When it is desired to stake the umbrella 10 into the ground, cap 17 is first removed from the threaded shank's storage section 21, and the pin 15 itself is then unscrewed out of the handle section's storage chamber 24. Thereafter, the pin's orientation is reversed, and the threaded shank's use section 21 is threaded into the handle section's open end 26 until collar 20 abuts and stops against the free end edge 26 of that handle section. In this stake position, the cap 17 is carried in the user's pocket, and the umbrella can be staked into the ground, e.g., a golf green or golf fairway, as illustrated in FIG. 1. In this staked use of the umbrella 10, it is quite apparent that the umbrella cannot blow away, and that rain can not collect on the inside surface of the umbrella's cover 12.

Having described in detail the preferred embodiment of my invention, what I desire to claim and protect by Letters Patent is:

1. An improved umbrella structure comprising a centerpost having an umbrella cover fixed thereto at one end, a rib structure connected between said centerpost and said cover, said rib structure being operable to open and close said umbrella as desired by a user, a handle section fixed to said centerpost at the other end, said handle section defining a storage chamber therein, a reversible pin having a stake-like point at one end and a connector at the other end, said connector being operable to connect said pin to said handle section in a stake position so that said stake-like point is exposed for staking said umbrella to ground and in a storage position where said stake-like point is seated in said storage chamber, a cap engageable with said connector when said pin is in said storage position, said cap cooperating with said handle section to establish an aesthetically pleasing contour to said handle, said handle section and pin defining a generally linear axis in said stake position, and said handle section, said pin and said cap defining a generally linear axis in said storage position, and a collar on said pin in combination with said connector, said collar serving to locate and to stop said pin in said stake position and in said storage position when in abutting relation with said handle section.

2. An umbrella structure as set forth in claim 1, said collar, said cap and said handle cooperating to establish an aesthetically acceptable contour to said handle, the outside diameter of said collar being substantially the same as the outside diameter of said cap and said handle in those areas of said cap and said handle adjacent to said collar.

3. An umbrella structure as set forth in claim 1, said connector comprising a threaded shank, said threaded shank being threadedly engageable with said handle section and said cap.

* * * * *